United States Patent [19]

Omori

[11] 4,026,546

[45] May 31, 1977

[54] BICYCLE PEDALING STAND

[75] Inventor: Hisashi Omori, Kobe, Japan

[73] Assignee: Kabushiki Kaisha Kawamura Saikuru, Japan

[22] Filed: Feb. 9, 1976

[21] Appl. No.: 656,694

[52] U.S. Cl. ..... 272/73; 280/293; 211/22

[51] Int. Cl.[2] ..... A63B 69/16

[58] Field of Search ..... 272/73; 280/293, 294, 280/295, 296, 300, 303; 211/17, 22

[56] References Cited

UNITED STATES PATENTS

| | | | |
|---|---|---|---|
| 260,053 | 6/1882 | Sawyer | 280/293 X |
| 359,800 | 3/1887 | McClintock | 280/293 X |
| 3,107,915 | 10/1963 | Looney | 272/73 |

FOREIGN PATENTS OR APPLICATIONS

| | | | |
|---|---|---|---|
| 52,402 | 6/1890 | Germany | 272/73 |
| 475,207 | 11/1937 | United Kingdom | 272/73 |
| 17,570 | 8/1898 | United Kingdom | 272/73 |
| 3,683 | 2/1893 | United Kingdom | 208/156 |

*Primary Examiner*—Richard C. Pinkham
*Assistant Examiner*—Arnold W. Kramer
*Attorney, Agent, or Firm*—Wenderoth, Lind & Ponack

[57] ABSTRACT

A device for pedaling a bicycle in a stationary state, for the purpose of physical training or bicycle testing. This device, a kind of bicycle stand, comprises a member for unmovably holding a front wheel of a bicycle and the other member for sustaining a pair of rollers on which a rear wheel of the bicycle is rotatably placed, said members being formed at or connected to both longitudinal ends respectively of a strip of plate, and a bicycle supporting frame extending vertically aslant in connection with the above-mentioned strip of plate, in the foregoing construction this device enabling a bicycle to be pedaled in a stationary state on this device and accordingly enabling the attainment of a physical training without going outdoors. This device also serves for stationary testing a bicycle for its running and/or braking efficiency. The length and height of the above-mentioned strip of plate and bicycle supporting frame respectively and further the distance between the pair of rollers may be changed predeterminedly so as to adjust to the length and height of the bicycle and diametrical size of its rear wheel, and further a load may be imposed on the bicycle pedaling by applying any suitable friction to the rotation of said rollers so as to add to the physical training effect.

3 Claims, 6 Drawing Figures

BICYCLE PEDALING STAND

This invention relates to a device on which a bicycle can remain standing rotatably at its rear wheel, and more specifically this invention relates to a device whereby the front wheel of the bicycle is unmovably fitted in a grooved portion and its rear wheel is rotatably placed between and on a pair of rollers which are fixed so as to rotate accompanying the rotation of said rear wheel, the rotation of said rollers being frictionally controlled by any suitable means so as to impose a load on the rotation of said rear wheel thereby making the pedaling of said bicycle more difficult and accordingly more suitable for physical training as may be similar to that in outdoor cycling.

A main object of this invention is to provide an inexpensive device by which a bicycle is used for physical training at home or at any narrow spot.

A second object of this invention is to provide an inexpensive device enabling the testing of a bicycle of its running and/or braking efficiency without running it on the street.

This invention will be more fully described by way of examples with reference to the accompanying drawings, in which.

Figure 1:
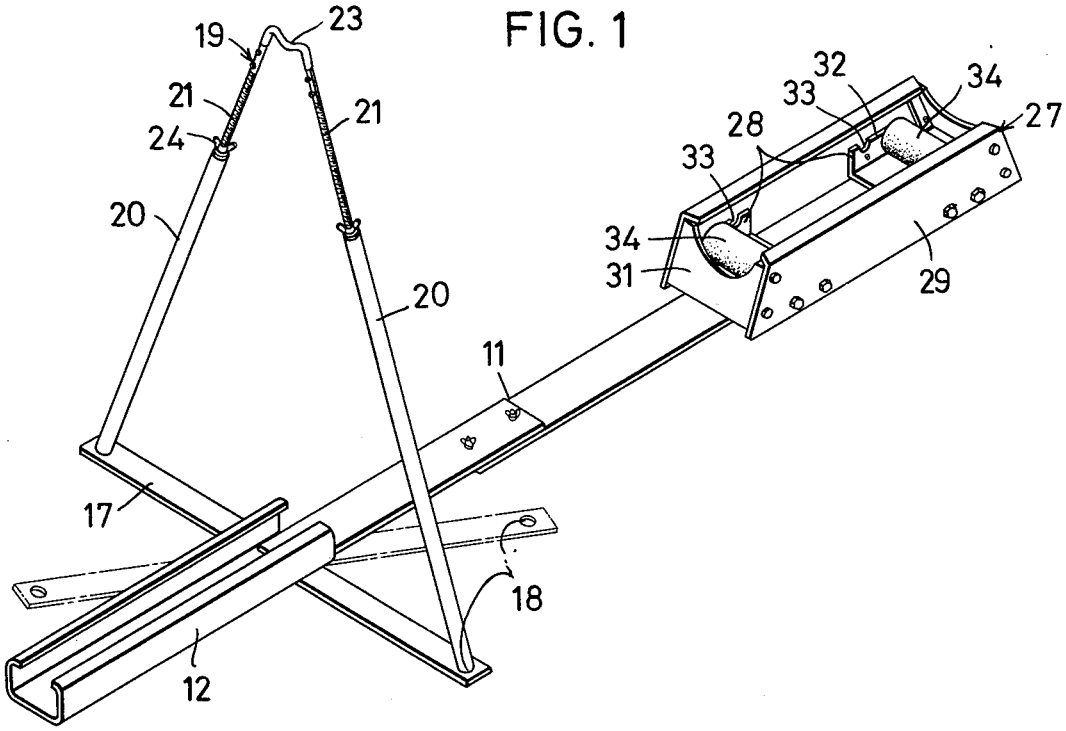
FIG. 1 is a perspective view of this invention device in an assembled state.

In the drawing, numeral 11 designates a strip of plate as a base of this invention, this base plate 11 consisting of two strips of plates connected detachably at more than one positions by nuts and bolts. The base plate 11 at one end thereof forms or connects to a front wheel-holder 12 andd at the other end also forms or connects to a rollers-sustainer 27 as referred to in detail hereinafter.

Figure 5:
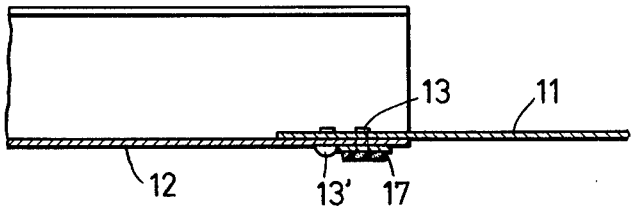
FIG. 5 is a vertical sectional view of a joint of the base plate and a front wheel-holder constituting a forward end portion of this invention device.

The above-mentioned front wheel-holder 12 is longitudinally elongated and grooved so as to be suitable for stably admitting a front wheel 15 of a bicycle 14 at its lower portion. In this case, the holder 12 connects to the base plate 11 by rivets 13 and 13′, as clarified in FIG. 5, in a state that the base plate 11 at its forward end portion partially overlaps the inside bottom of said holder 12. The upward opening of said holder 12 is preferably a bit wider than the thickness of the front wheel 15 so that the wheel 15 may be easily fitted therein.

A stay 17 is connected to the under surface of the front wheel-holder 12 also by the above-mentioned rivet 13, said stay 17 being pivotally and horizontally rotatable round said rivet 13 in one direction so as to become parallel longitudinally with the holder 12 whereby the device of this invention becomes more convenient to store when unused. When supporting a bicycle, the stay 17 is positioned at a right angle to the front wheel-holder 12 and is prevented from rotating in direction opposite to the above-mentioned direction by a downwardly-projective portion of the aforementioned rivet 13′.

Figure 6:
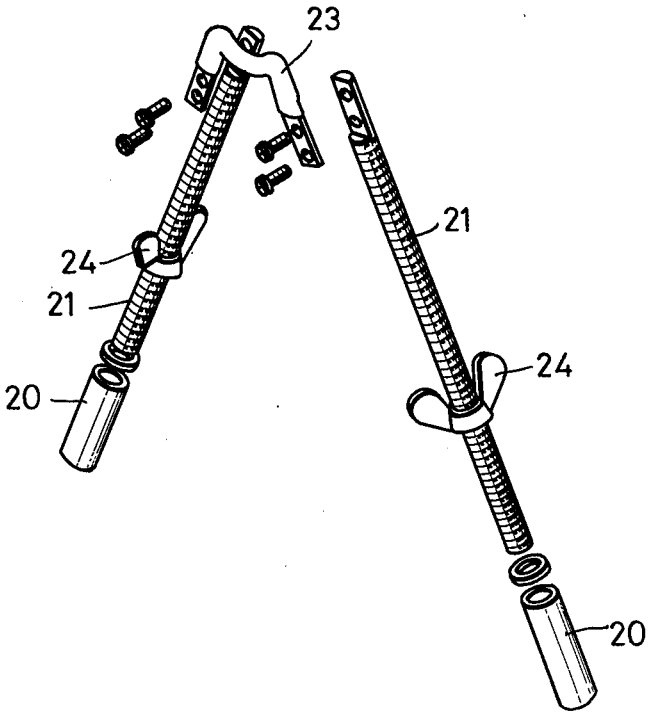
FIG. 6 is a partially broken perspective view in a disassembled state of a frame in support of a bicycle to keep it standing.

The stay 17 is provided with holes 18 one each at both of its ends, through said holes 18 extend two pipes 20 which constitute the lower portion of a bicycle supporting frame 19, the frame 19 being so constituted that the pipes 20 extend from the ground upwardly and aslant in their mutually approaching direction whereby two elongated bolts 21 are inserted one each detachably and longitudinally in said pipes 20 at their upper ends. Said bolts 21 join each other at their upper ends through the medium of a prop 23 which is formed like a mountain with its summit being centrally-downwardly recessed, said prop 23 at the lower end of its sloping portions connecting to the upper ends of said bolts 21 by screws as manifested in FIG. 6. Wing nuts 24 are fitted one each to said bolts 21 spirally-rotatably therearound so that said bolts 21 may be controlled in the length of their inserted portion in said pipes 20 and accordingly the height of the bicycle supporting frame 19 may be adjusted to the height of a bicycle 14 to be supported.

The bicycle supporting frame 19 constituted as above supports a bicycle 14 at its fork 25 in a manner that the fork 25 is fitted in said recessed portion of the prop 23 at a point where the fork 25 crosses a forward frame 26 of the bicycle 14.

Figure 2:
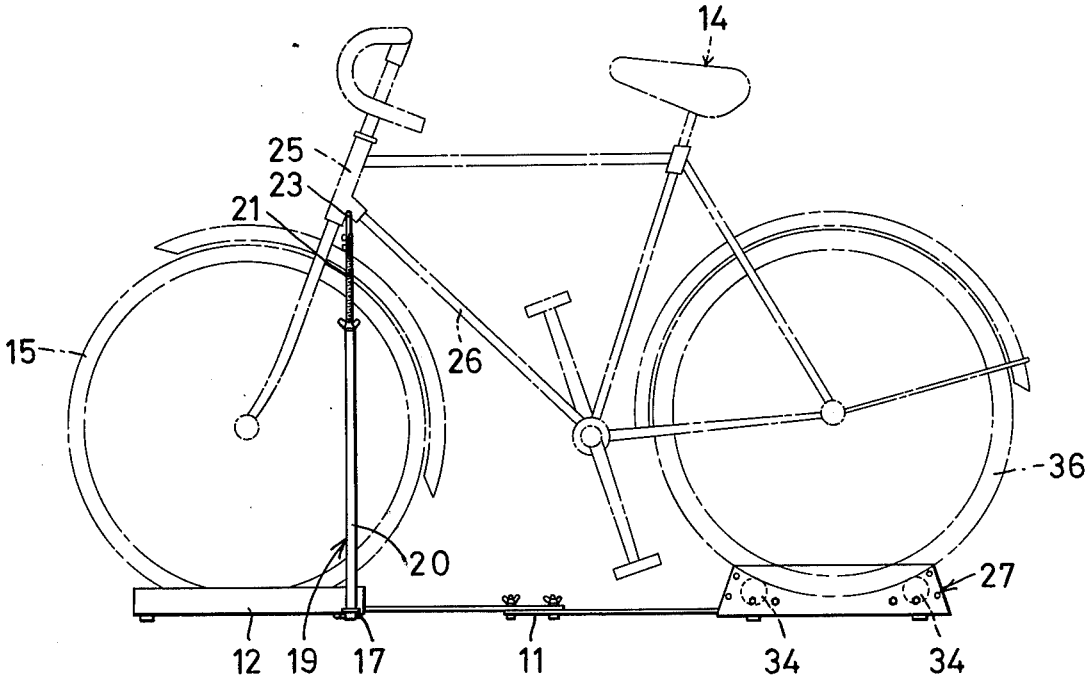
FIG. 2 is a side view of this invention device on which a bicycle is mounted.
Figure 3:
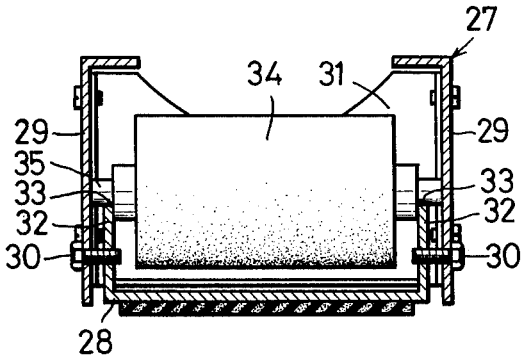
FIG. 3 shows a vertical longitudinal section of a rollers-sustainer constituting a rear end portion of this invention device.
Figure 4:
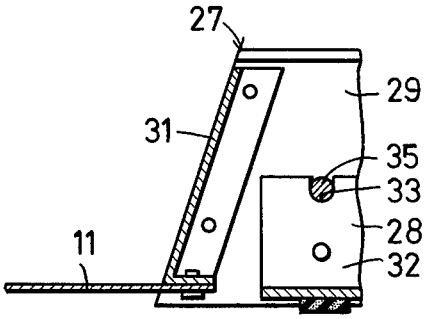
FIG. 4 is a vertical sectional view of a joint of the rollers-sustainer and a base plate of this invention.

A rollers-sustainer 27 is fixed to the rear of said base plate 11, said sustainer 27 in an upwardly-open rectangular form consisting of said plates 29 disposed erectly side by side in the longitudinal direction of said plate 11 and end walls 31 connecting to said side walls 29 at their ends. The side walls 29 intermediately at the forward and rearward portions of their inner surfaces have two roller-holding members 28 fixed thereto by screws 30, as seen in FIG. 2, said members 28 each consisting of vertically erected side walls 32 connected to each other via a bottom plate whereby it is fixed at said side walls 32 to the inner surface of said walls 29 of the rollers-sustainer 27 with the bottom plate of said member 28 lapping over the bottom of said rollers-sustainer 27. The side wall 32 of said member 28 at its upper edge is provided with downward recesses 33 at least at two positions so that a roller 34 may be placed axially rotatably in said recesses 33 at both ends of its axis 35 so as to extend between the side walls 32 at a right angle to said rollers-sustainer 27.

Now repeating the description about this invention, thus, between the two rollers 34 which rotate accompanying the rotation of said wheel 36, the distance between said rollers 34 being changeable by changing the position of said rollers 34 to and from the recesses 33. Also, the base plate 11 may be changed in length predeterminedly by replacing the nuts and bolts detachably connecting the two strips of plates as referred to hereinbefore.

The device of this invention device thus enables the attainment of physical training at home as effective as in outdoor cycling, still more, this device enables one to adjust to the physical condition or strength of a bicycle rider in relation to his physical training as referred to at the outset of this description. Also, this invention device may be used for testing a bicycle of its running and/or braking efficiency without running it on the street.

What is claimed is:

1. A bicycle stand and training roller, which comprises a bicycle wheel supporting body which comprises a base plate strip and two side-walled, elongate bicycle wheel-supporting members each fixed to said base plate by rivets at each of the longitudinal ends thereof, one member for holding the front wheel stationarily and the other member incorporating rollers so as to support the rear wheel rotatably on said rollers, and a frame for uprightly sustaining the bicycle which comprises a strip of plate having holes at each of the logitudinal ends thereof and being pivotally fitted by one of said rivets in a horizontally-semicircularly rotatable state at its intermediate portion to the joint of the base plate and the front wheel-holding member, and two pipes extending from the ground through said holes upwardly in their mutually-approaching directions, two elongate bolts being inserted in said pipes respectively at their upper ends, the length of the inserted portion of said bolts being adjustable by wing nuts fitted one each around said bolts, said bolts at their upper ends joining each other by the medium of a hook of a mountainlike form with its summit being centrally recessed downwardly and the lower ends of its sloping portions connecting to upper ends of said bolts by screws, said downwardly recessed portion being adapted to accept a bicycle at the point where the fork joins the front of the frame of said bicycle.

2. a bicycle stand as claimed in claim 1, in which the base plate consists of two strips of plate connected detachably to each other at one or more than one points by bolts and nuts.

3. A bicycle stand as claimed in claim 1, in which the front wheel holding member is elongated in the longitudinal direction of said base plate, said member consisting of side plates and a bottom plate, said side plates being erected from sidewise ends of said bottom plate thereby forming an upwardly-open longitudinal groove also open at both ends, the width of said groove being slightly bigger than the thickness of the front wheel.

* * * * *